US005980366A

United States Patent [19]

Waddle et al.

[11] Patent Number: 5,980,366

[45] Date of Patent: Nov. 9, 1999

[54] METHODS AND APPARATUS FOR POLISHING USING AN IMPROVED PLATE STABILIZER

[75] Inventors: Thomas Waddle, Phoenix; Karl Kasprzyk, Gilbert, both of Ariz.

[73] Assignee: Speedfam-IPEC Corporation, Chandler, Ariz.

[21] Appl. No.: 08/986,898

[22] Filed: Dec. 8, 1997

[51] Int. Cl.[6] ..... B24B 7/04

[52] U.S. Cl. ..... 451/262; 451/269; 451/271; 451/342

[58] Field of Search ..... 451/262, 263, 451/264, 265, 266, 267, 268, 269, 340, 342, 343

[56] References Cited

U.S. PATENT DOCUMENTS

| | | | |
|---|---|---|---|
| 240,966 | 3/1881 | Chappell | 451/268 X |
| 1,509,823 | 9/1924 | Blood | 451/262 X |
| 1,838,553 | 12/1931 | Kadow et al. | 451/265 |
| 1,949,514 | 3/1934 | Elstub | 451/268 |
| 2,328,809 | 9/1943 | Johnson | 451/262 X |
| 3,537,214 | 11/1970 | Ford | 451/264 |
| 4,433,510 | 2/1984 | Katagirl et al. | 451/269 X |
| 5,762,543 | 6/1998 | Kasprzyk et al. | 451/262 |
| 5,782,678 | 7/1998 | Cesna et al. | 451/269 |

*Primary Examiner*—Timothy V. Eley
*Attorney, Agent, or Firm*—Snell & Wilmer L.L.P.

[57] ABSTRACT

A plate stabilizing apparatus is provided which comprises a lateral support structure conflgured to adjust plate alignment which engages vertical rails secured to a polishing machine housing. thus effectively stabilizing the polishing plate while allowing vertical movement of the plate assembly. In a preferred embodiment, a plate stabilizing apparatus includes an alignment plate secured to a subcylinder close to and axially aligned with the polishing plate universal joint. Adjustment screws are provided for lateral adjustment of the polishing plate which is secured to a substantially rigid lateral support structure. The lateral support structure rides within vertical rails secured to the inner housing walls of the polishing apparatus thus allowing vertical movement of the polishing plate during operation.

6 Claims, 6 Drawing Sheets

METHODS AND APPARATUS FOR POLISHING USING AN IMPROVED PLATE STABILIZER

TECHNICAL FIELD

The present invention relates. generally, to techniques for polishing workpieces and, more particularly, to the use of an improved technique of plate stabilization which reduces the need for frequent realignment and reduces misalignment due to polishing machine positional changes.

BACKGROUND ART AND TECHNICAL PROBLEMS

Polishing technology has been largely driven by the need for exceptionally smooth and planarized surfaces on high-tech materials and components such as magnetic disks, semiconductors. and the like. In the case of semiconductor wafers, for example, polishling, techniques are employed, not just for polishing and planarizing the bulk wafer, but for planarization of those layers which comprise the active circuitry; e.g., conductor metals. passivation, and interlayer dielectrics.

In a paradigmatic polishing operation, a platen/polishing-pad assembly is employed in conjullction with a slurry, for example a water-based slurry comprising colloidal silica particles. When pressure is applied between the polishing pad (e.g., a polyurethane pad) and the workpiece being polished. mechanical stresses are impaited to the workpiece surface. Abrasive particles within the slurry act to create zones of localized stress. which in turn creates mechanical strain on the chemical bonds comprising the surface being polished. Consequently, microscopic regions are removed from the surface being polished, enhancing planarity of the polished surface.

Furthermore, in a chemical-mechaanical planarization context (CMP), the slurry is used to effect chemical as well as mechanical polishing and planarization. More particularly, the slurry suitably comprises a chemically and mechanically active solution, for example, abrasive particles coupled with chemically reactive agents. Suitable chemically reactive agents include hydroxides but may also include highly basic or highly acidic ions.

See, for example, Arai, et al., U.S. Pat. No. 5,099,614, issued March, 1992; Karlsrud, U.S. Pat. No. 5,498.196, issued March, 1996; Arri, et al., U.S. Pat. No. 4,805,348, issued February, 1989; Karlsrud et al., U.S. Pat. No. 5,329,732, issued July, 1994; and Karlsrud et al., U.S. Pat. No. 5,498,199, issued March, 1996, for further discussion of presently known lapping and planarization techniques. By this reference. the entire disclosures of the foregoing patents are hereby incorporated herein.

A key variable used to characterize a particular polishing or grinding process is the material removal rate. The material removal rate of a process is simply the rate at which material is removed from the workpiece surface, and is typically expressed as a length prr unit time (e.g.. microns per minute).

Many factors can and do affect material removal rate. For example, the material properties of the polishing surface, the mechanical and chemical properties of the slurry, and the properties of the workpiece surface itself are all important factors. In addition, and more important for the purposes of the present invention, removal rate is a strong function of applied pressure. That is, removal rate increases as the local normal compressive force applied to the workpiece surface increases.

Presently known polishing/grinding techniques are unsatisfactory in several regards. In many polishing configurations, for example, particularly where processing of multiple or large workpieces is performed, material removal rate can vary significantly from workpiece-to-workpiece and across individual workpieces themselves due to plate misalignment. More particularly. even when optimum plate alignment is achieved during initial setup, small changes in polishing machine position and orientation can have a significant impact on plate alignment due to a lack of robustness in presently known stabilization techniques. Such changes might occur, for example, due to movement of the building in which the polishing machine resides, or larger scale changes due to seismic shifts.

Presently known techniques are also unsatisfactory in that, over time, day-to-day operation of a typical polishing machine can also result in plate misalignment. Tllis misalignment can be remedied by repeated realignments pursuant to a preventive maintenance schedule; however, such realignments can be quite frequent, resulting in substantial machine down-time.

Polishing techniques are thus needed which provide improved plate stabilization, thus reducing variations in workpiece pressure during polishing.

SUMMARY OF THE INVENTION

The present invention provides methods and apparatus for polishing plate stabilization which addresses and resolves the shortcomings of the prior art described above.

In accordance with the present invention a plate stabilizing apparatus is provided which comprises a lateral support structure configured to adjust plate alignment which engages vertical rails secured to the polishing machine housing, thus effectively stabilizing the polishing plate while allowing vertical movement of the plate assembly.

In a preferred embodiment, a plate stabilizing apparatus includes an alignment plate secured to a subcylinder close to and axially aligned with the polishing plate universal joint. Adjustment screws are provided for lateral adjustment of the polishing plate, which is secured to a substantially rigid lateral support structure. The lateral support structure rides within vertical rails secured to the inner housing walls of the polishing apparatus, thus allowing vertical movement of the polishing plate during operation.

In accordance with one aspect of the present invention, plate misalignment due to shifts in polishing machine position are substantially minimized, resulting in more uniform pressure which improves workpicce material removal rate. In accordance with a further aspect of the present inventions plate misalignment due to day-to-day operation of the polishing machine is reduced, substantially decreasing the need for periodic realignments.

BRIEF DESCRIPTION OF THE DRAWING FIGURES

The subject invention will hereinafter be described in conjunction with the appended drawing figures, wherein like numerals designate like elements, and:

DETAILED DESCRIPTION OF PREFERRED EMBODIMENTS

Figure 1:
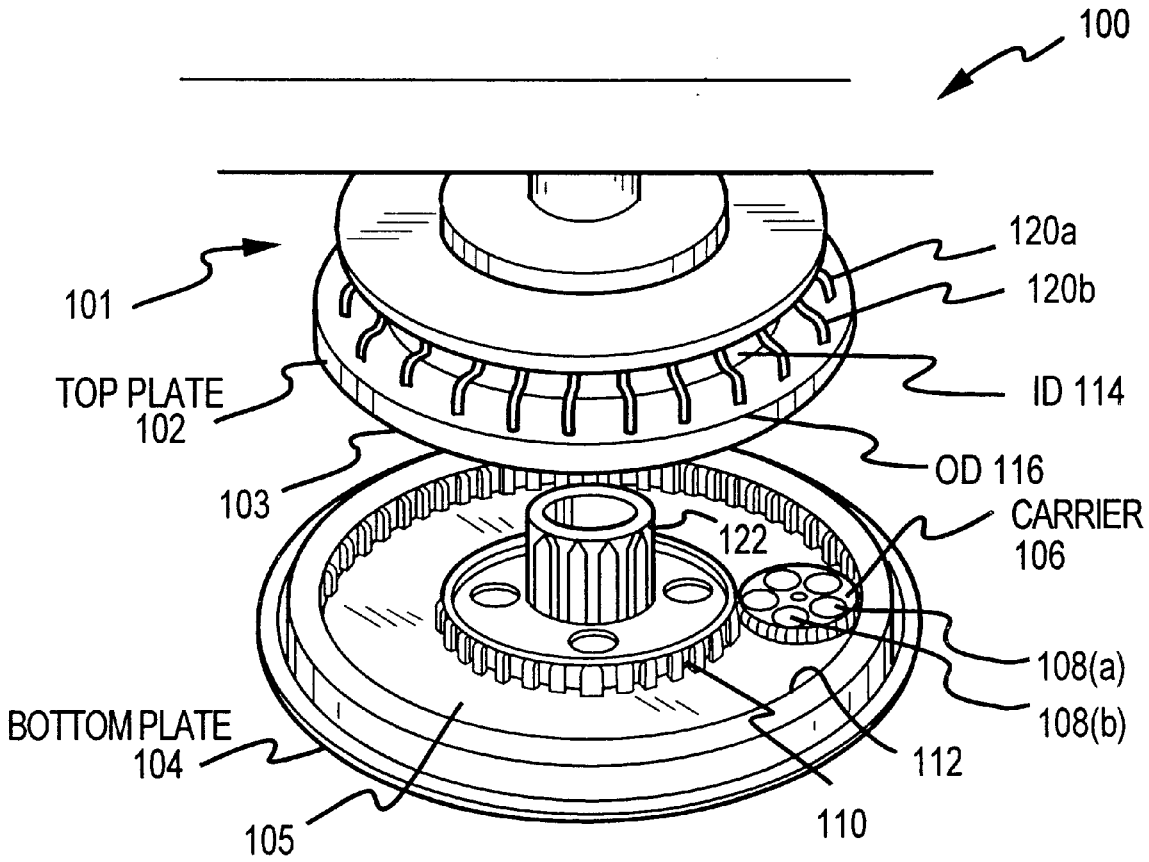
FIG. 1 is an illustration showing an exemplary double-side polishing apparatus.

With reference to FIG. 1, an exemplary polishing apparatus will now be described. As a preliminary matter, the terms "polishing" and "polisher" as used herein embrace a wide range of both wet and dry planarization techniques. Examples include chemical-mechanical polishing, lapping, grinding, honing, slurry polishing, and chemical-mechanical planarization (CMIP). As the primary goal of the present invention is to enhance material removal rate uniformity by providing substantially equal pressure over a workpiece or workpieces, the present invention may be advantageously employed in a variety of contexts.

Double-side polishing apparatus 100 useful in illustrating the present invention suitably comprises a top plate 102. a plurality of slurry supply lines 120, a bottom plate 104, and a carrier 106 for housing at least one workpiece 108. The bottom surface (not shown) of top plate 102 and the top surface of bottom plate 104 comprise a suitable polishing material, thereby forming polislling surfaces 103 and 105 respectively.

Polishing materials suitable tor use with the present invention include, for example, polishing pads, grinding stones, diamond pellet, lapping plates, and the like.

Carrier 106 may suitably be configured such that both the top and bottom surfaces of workpieces 108 are exposed; that is, the carrier itself contacts workpieces 108 only along their outer edges, allowing both the top and bottom surfaces of workpieces 108 to be polished simultaneously.

Surface 105 of bottom plate 104 is bordered by inner ring 110 and outer ring 112. Carrier 106 is situated between and preferably in contact with both rings 110 and 112.

Rings 110 and 112 are preferably provided with gear teeth which mesh with comparable teeth disposed along the circumference of carrier 106. Alternatively, rings 110 and 112 may be provided with pins serving the same purpose. In either case, rings 110 and 112 are typically referred to as the "sun gear" and "ring gear" respectively. It will be appreciated that this configuration allows significant flexibility in choosing carrier movement. By altering the direction and angular velocity of rings 110 and 112 which are suitably independent the orbital path of carrier 106 may be precisely specified.

Top plate 102 is preferably configured such that, during polishing, it seats within the region defined between rings 110 and 112. Specifically, top plate 102 is preferably ring-shaped, wherein its inner and otiter diameters (ID 114 and OD 116) substantially correspond to inner ring 110 and outer ring 112 respectively.

During operation, top plate 102 may be lowered vertically such that polishing surface 103 makes contact with the top surface of workpieces 108 in carrier 106. Driver 122 provides rotation of plate 102 by meshing with keys provided on the underside (not shown) of top assembly 101. Pressure is provided at the interface of workpieces 108 and polishing surface 103 by virtue of the weight of top plate 102 and other contiguous assembly elements. That is, the weight of top assembly 101 supplies any downward force required for polishing.

Figure 2:
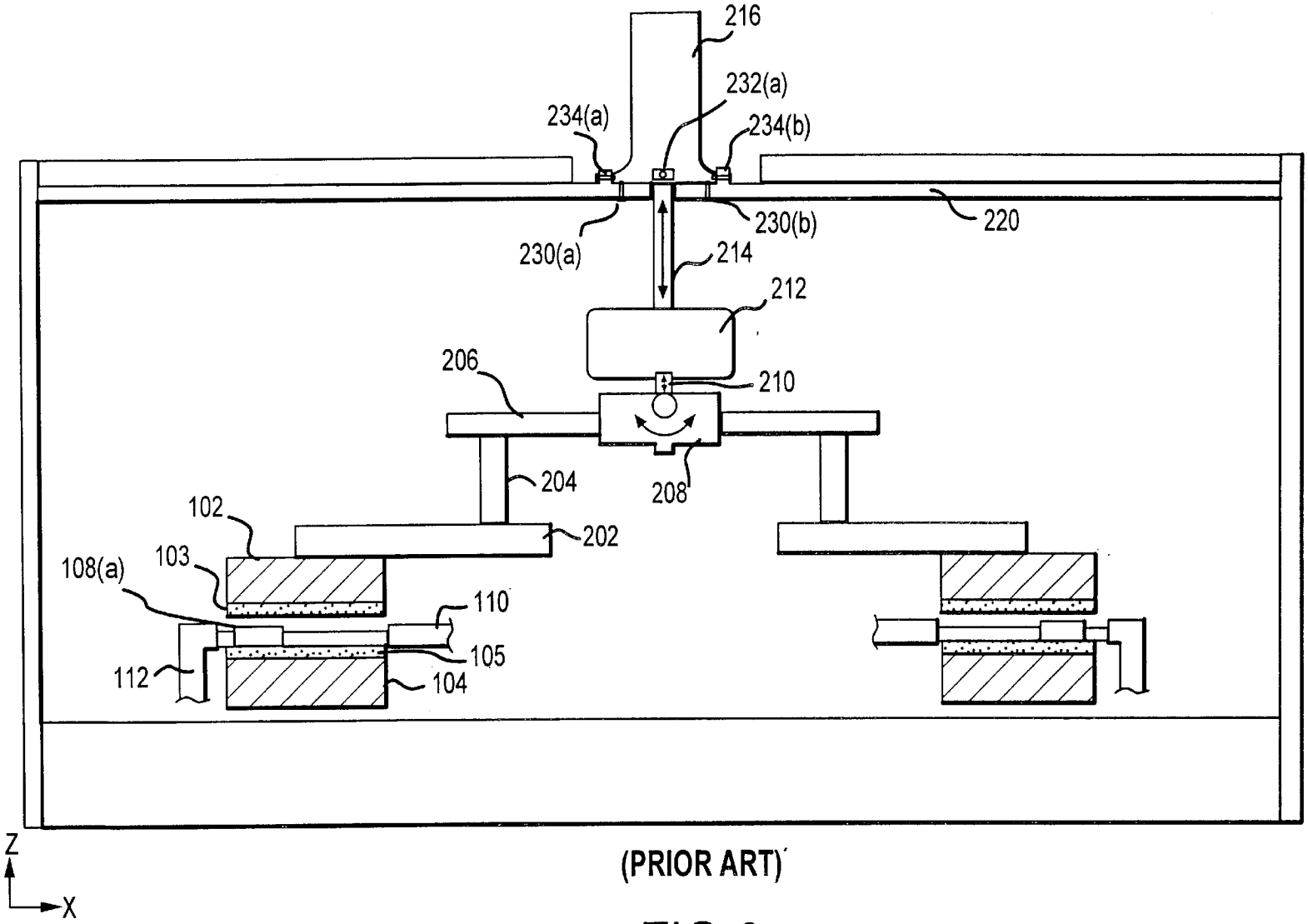
(PRIOR ART) FIG.2
FIG. 2 is a schematic drawing showing a simplified cross-sectionl view oi a typical prior art polishing apparatus.

As illustrated in FIG. 2, the top side of plate 102 is typically secured by a ringshaped backing plate 202, which is attached via supports 204 to plate 206. It will be appreciated that FIG. 2 presents a simplified model, wherein certain details of the polishing apparatus are lef out for purposes of clarity, most notably plate driver 122 and slurry supply lines 120 (shown in FIG. 1).

With continued reference to FIG. 2. plate 206 is attached to universal joint 208. which allows free rotation of plate 206 about its central axis while at the same time allowing a limited rocking movement of the top assembly ("top assembly" in this context refers to plate 206, supports 204, plate 202, and plate 102). It will be appreciated that the increased degrees of freedom provided by universal joint 208 allow for more uniform distribution of stresses on polishing Surface 103 during processing.

Universal joint 208 is attached by a shaft 210 moveably attached to subcylinder 212. Shaft 214, attached to the top of subcylinder 212, is moveably disposed within main cylinder 216. Consequently, the vertical translation of top plate 102 is controlled by the movement of shaft 214 within main cylinder 216 and shaft 210 within subcylinder 212. This movement is preferably controlled by a computer controlled pneumatic actuator.

Because the downward force exerted during polishing is dependant on the extent to which the weight of the top assembly is permitted to rest on workpieces 108, polishing force is modulated by changing the upward force applied along shaft 214 by subcylinder 212. For example, it is conceivable that the full weight of the top assembly could be applied to workpieces 108 during polishing. In practice, however, due to the significant weight of such systems, doing so would result in excessive forces on workpieces 108. Thus, optimum polishing pressure in any particular case is achieved by balancing gravitational forces on the top assembly with the upward force along shaft 214.

Having thus described the operation of an exemplary prior art polishing system, it will be apparent that careful alignment of upper plate 102 with lower plate 104 is desirable. In this regard, currently known systems typically provide alignment control in the form of adjustment screws located near the base of main cylinder 216. Referring again to FIG. 2, typical systems provide a pair of X-axis adjustment screws 234, a pair Y-axis adjustment screws 232 (only adjustment screw 232(*a*) shown), and a set of four tilt adjustment screws 230 (only 230(*a*) and 230(*b*) shown). Adjustment screws 234 and 232 are used to center shaft 214 laterally with respect to bottom plate 104 (within the X-Y plane), while adjustment screws 230 are used to align shaft 214 substantially perpendicular to the polishing plane defined by bottom plate 104.

Although the aforementioned alignment scheme is satisfactory for initial setup and short-term operation, it is not robust to changes that might affect alignment over time. Small changes in polishing machine position and orientation can have a significant impact on plate alignment. Such changes might occur, for example. due to movement of the building in which the polishing machine resides, or larger scale changes due to seismic shifts.

Figure 3:
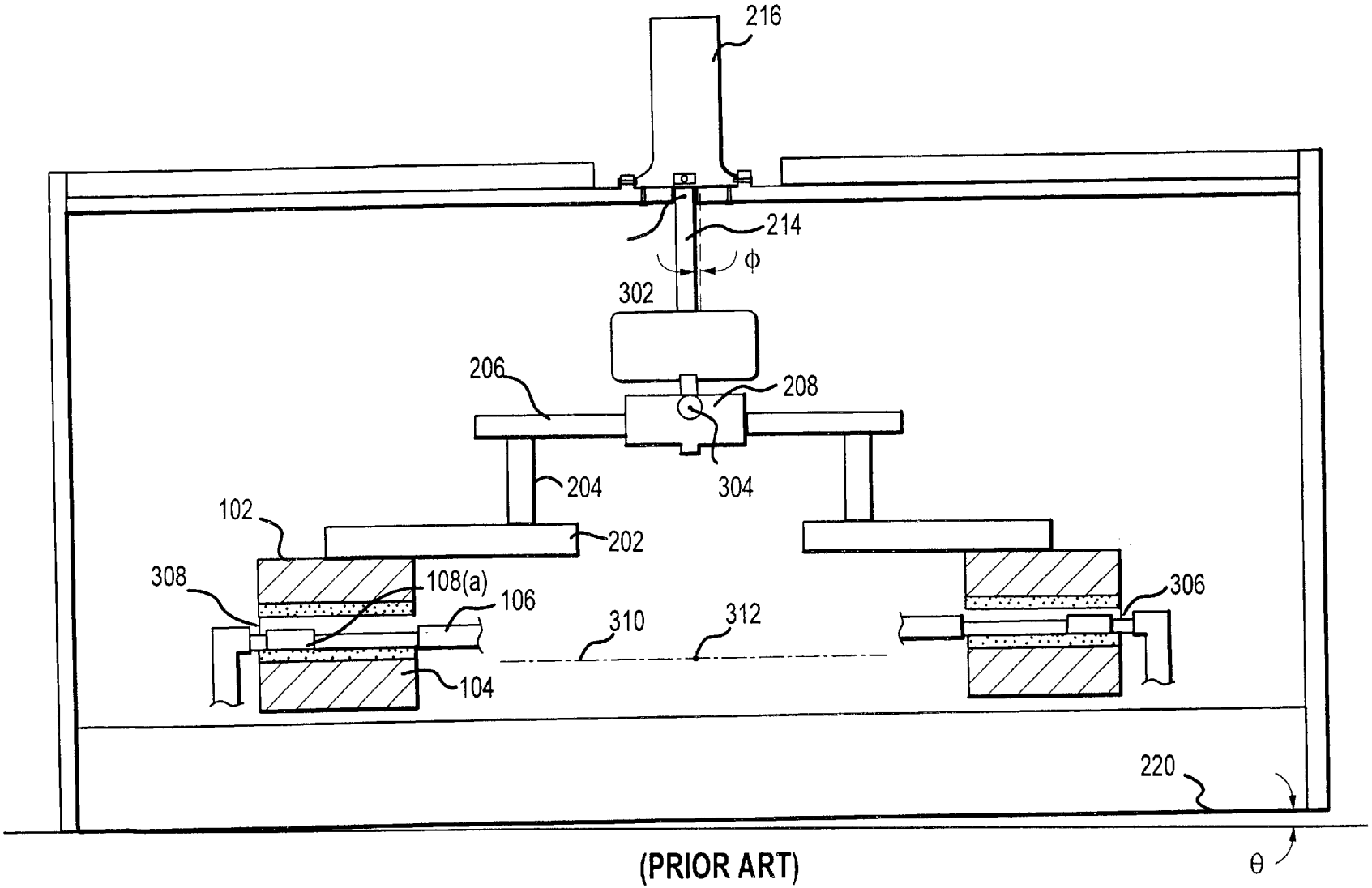
(PRIOR ART) FIG.3
FIG. 3 is a schematic drawing showing a simplified cross-section view of a typical prior art polishing apparatus subjected to a small angle of rotational.

For example, and with reference to FIG. 3, consider the case where polishing machine housing 220 experiences a small counterclockwise rotation by an angle θ as shown.

Notwithstanding successful set-up alignment as detailed above, when polishing apparatus housing 220 is sub jected to rotation, shaft 214 will pivot slightly by an angle $\phi$ (where $\phi$ is less than equal to $\theta$, depending on the compliance of shaft 214) about some point 302 close to the base of main cylinder 216. As a result, point 304 at universal joint 208 shifts slightly off center as shown with respect to bottom plate 104. And because universal joint 208 allows the top assembly to pivot freely, plate 102 (and hencc the polishing plane) will remain substantially parallel to the ground, causing misalignment as indicated by the disparity in distance between plate 102 and workpieces 108 at left edge 308 and right edge 306. Consequently, when plate 102 is lowered, the right edge of plate 102 will make contact with workpieces 108 first, and will bear a higher proportion of applied pressure during processing. This condition, which is sometimes referred to as "out of focus," results in significant variations in applied pressure. Thus, there are two primary goals in aligning top plate 104. First, shaft 214 should be substantially normal to the plane 310 detined by bottom plate 104. Second, point 304 (or some point suitably defining the center of plate 102) should be laterally centered above point 312 defining the center of bottom plate 104 (i.e., point 304 should lie on a line normal to plane 310 at point 312). At the same time, polishing plate 102 should be free to translate vertically via central shaft 214.

Figure 4:
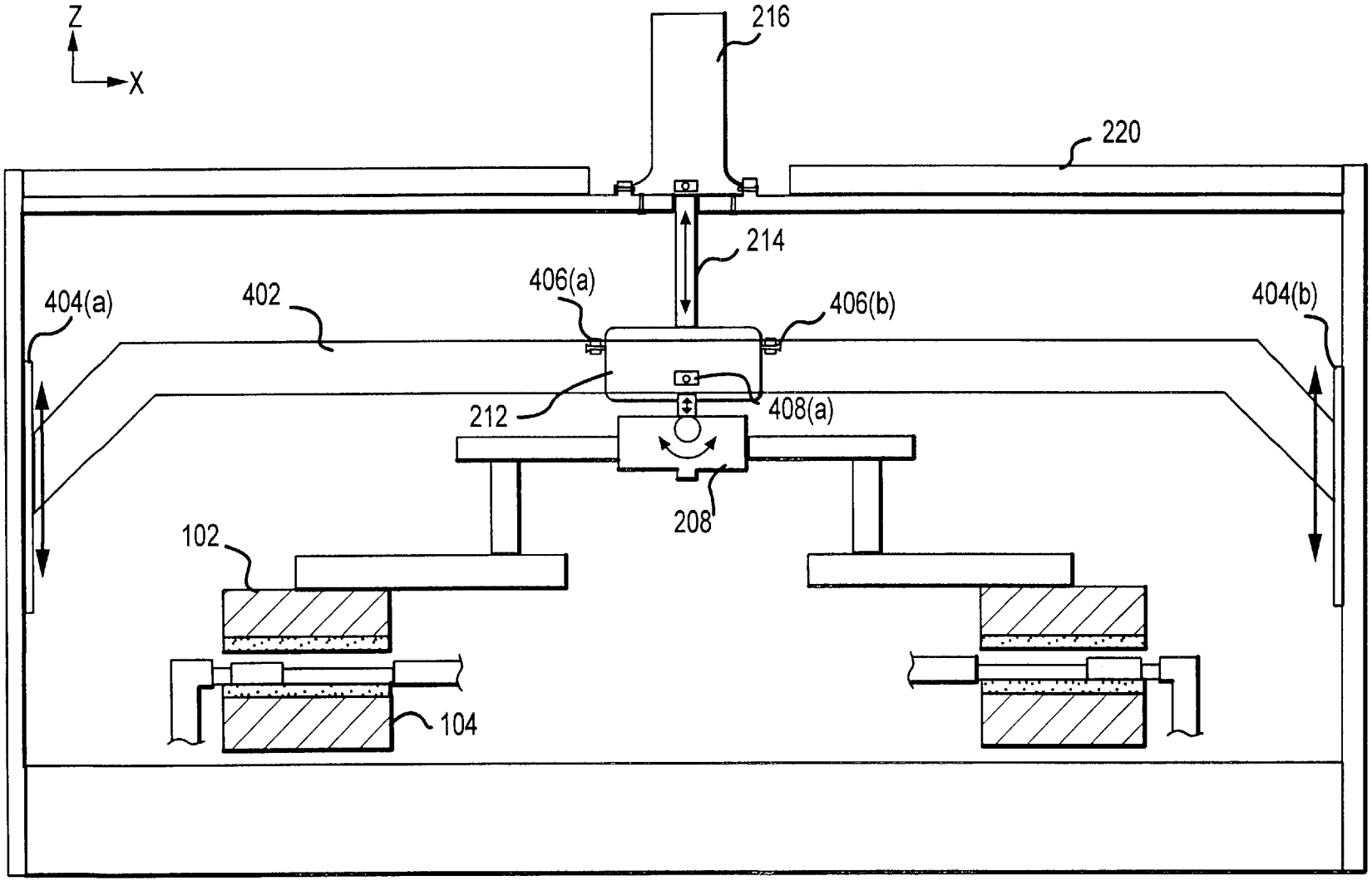
FIG. 4 is a schematic drawing showing a plate stabilizer in accordance with an exemplary embodiment of the present invention.

Referring now to FIG. 4, an overview of an exemplary embodiment of the present invention will now be described. A substantially rigid lateral support structure 402 is provided which engages vertical rails 404(*a*) and 404(*b*) on opposite sides of housing 220, or on other suitably secured structures which are rigidly connected with housing 220 of the polishing apparatus. Vertical rails 404(*a*) and 404(*b*) preferably allow only vertical translation of lateral support structure 402, which is used to stabilize shaft 214 at a point substantially close to universal joint 208. In the illustrated exemplary embodiment, for example, lateral support structure 402 is secured to subeylinder 212.

Adjustment screws 406 are provided for X-axis alignment, and adjustment screws 408 are provided for Y-axis adjustment (only 408(*a*) shown). Thus, lateral stabilization of shaft 214 is provided which at the same time allows vertical translation of universal joint 208. It will be appreciated that, in the event of rotation of the polishing machine as illustrated in FIG. 3, a stabilizing structure in accordance with the present invention will significantly reduce misalignment. As the misalignment component introduced by tilting of shaft 214 is substantially eliminated, the resulting lack of "focus" between plates 102 and 104 is significantly reduced.

Figure 5:
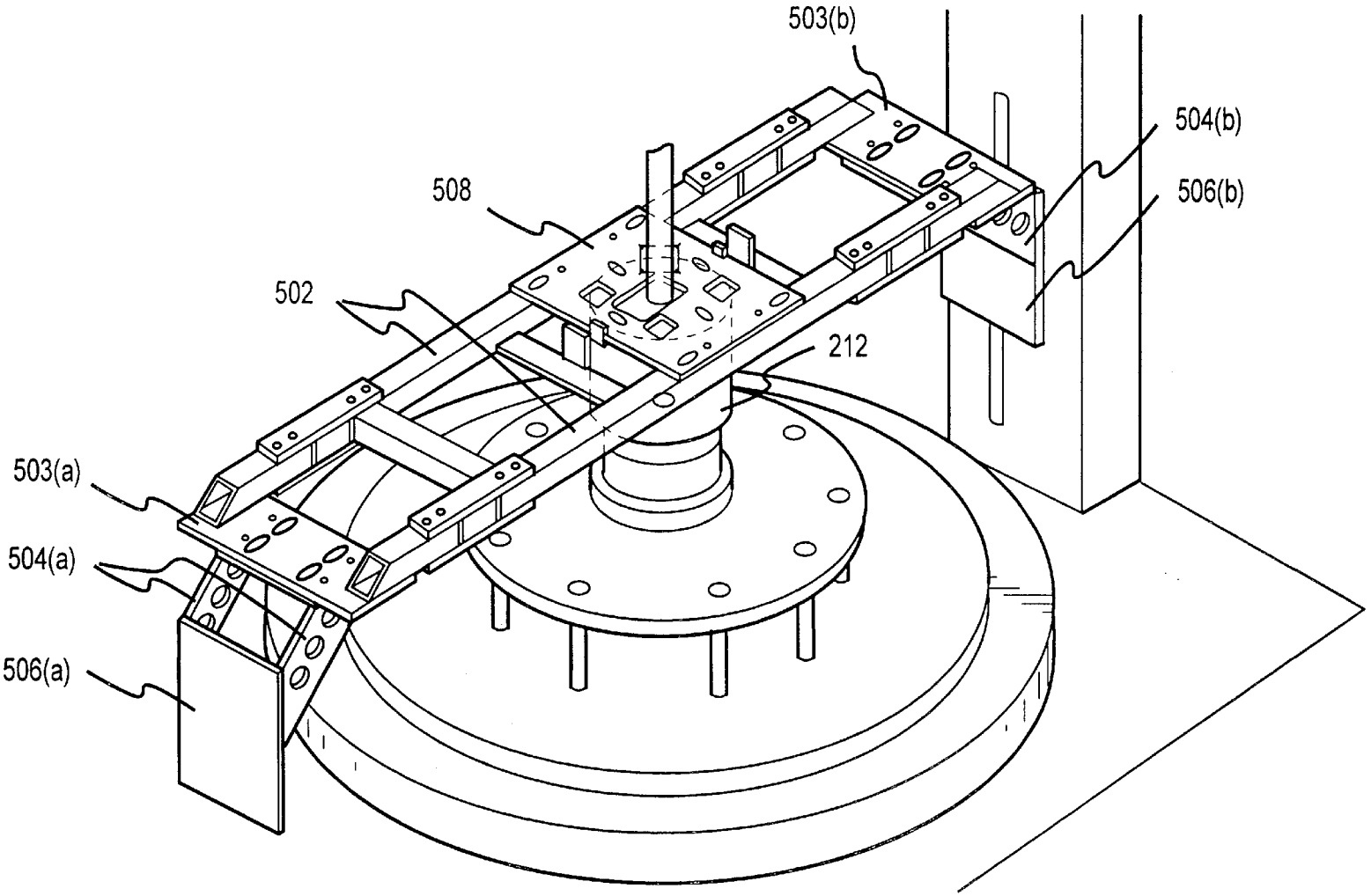
FIG. 5 is an isometric view of a plate stabilizer in accordance with a preferred embodiment of the present invention.
Figure 6A:
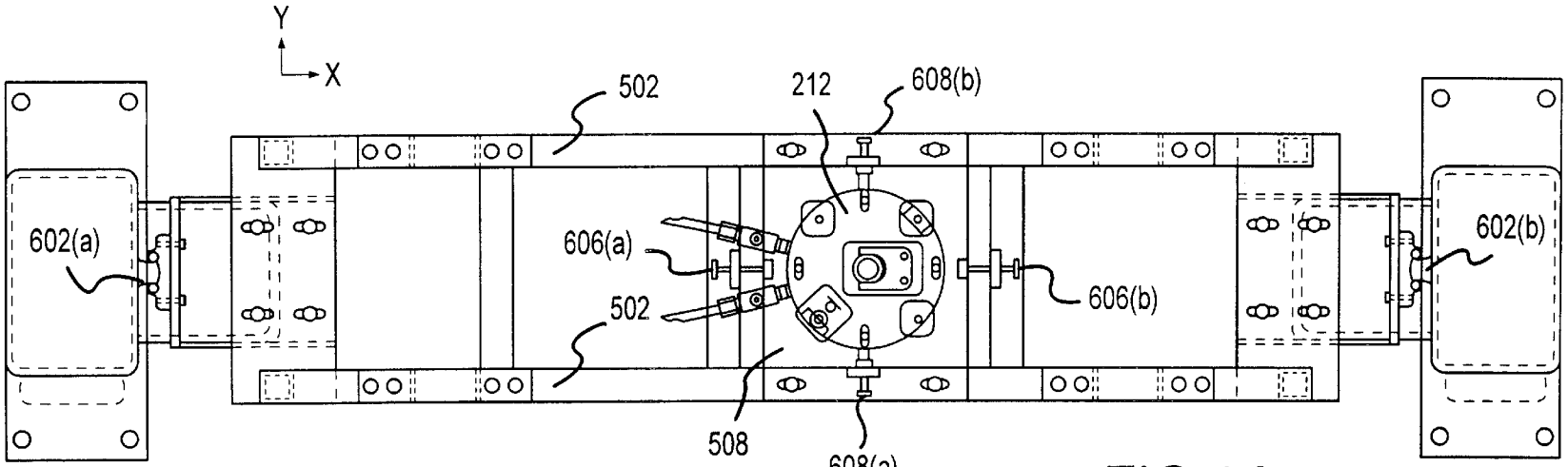
FIG. 6A and 6B are top and side views of a plate stabilizer in accordance with a preferred embodiment of the present invention.

Details of a particularly preferred embodiment of the present invention are presented in FIGS. 5, 6A. and 6B. In FIG. 5, an isometric view of a preferred lateral support structure is shown. More particularly, a pair of support beams 502 are suitably bolted near their ends to plates 503(*a*) and 503(*b*). Pairs of angled struts 504(*a*) and 504(*b*) are then used to rigidly secure plates 503 to vertical plates 506, which are attached to rails (not shown) to facilitate vertical translation of the lateral support structure. Alignment plate 508, which is secured to the top of subcylinder 212, is preferably attached to the top of beams 502.

Figure 6B:
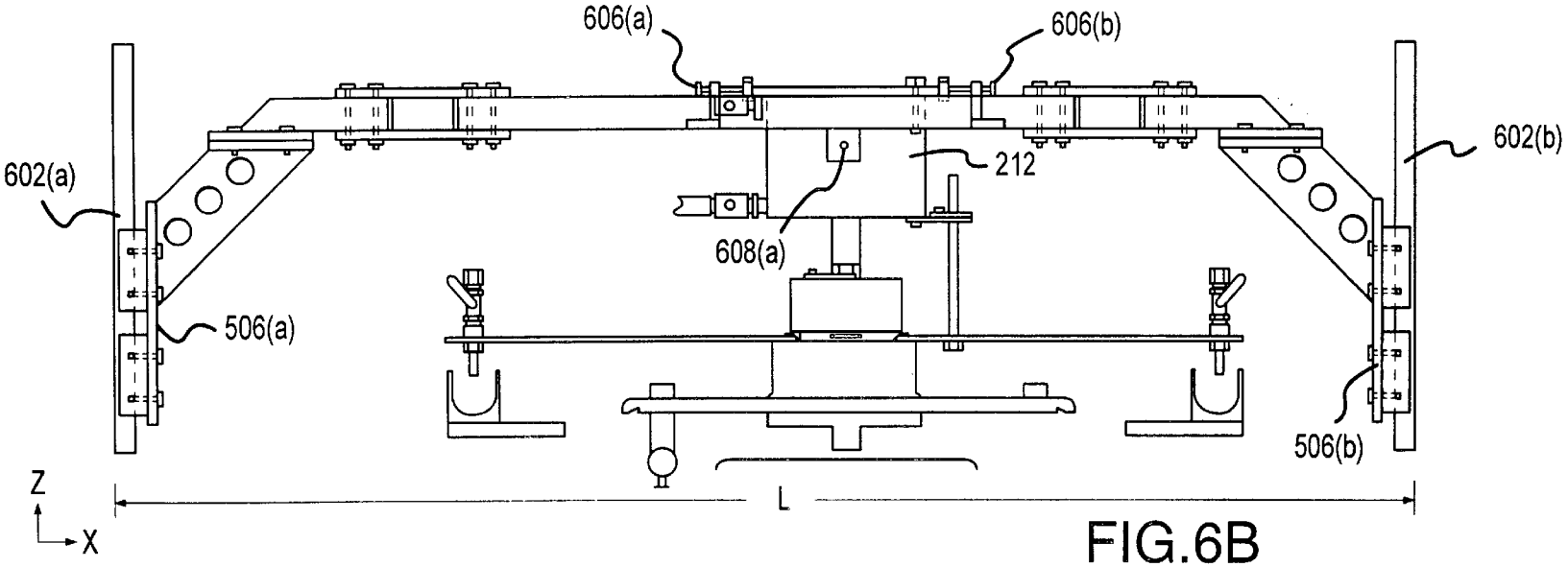

Referring now to FIGS. 6A and 6B. adjustment screws 606 (suitably anchored by struts secured between beams 502) provide X-axis adjustment by impinging upon opposite sides of alignment plate 508. Similarly, adjustment screws 608 anchored by beams 502 provide Y-axis adjustment by impinging upon opposite sides of subcylinder 212. Plates 506 ride within vertical rails 602(*a*) secured to the inner housing walls (not shown), thereby allowing Z-axis movement of the stabilizing structure. Preferably, the various structural components described are manufactured from suitably rigid materials. e.g., cold-rolled steel. In a particularly preferred embodiment. a stabilizing structure is employed in the configuration depicted in the scaled drawings shown in FIGS. 6A and 6B, wherein dimension L is approximately 190–196 cm. preferably about 193 cm.

Although the present invention is set forth herein in the context of the appended drawing figures, it should be appreciated that the invention is not limited to the specific forms shown. Various other modifications, variations, and enhancements in the design and arrangement of the support structures and various design parameters discussed herein may be made in the context of the present invention. For example, while the present invention is described in the context of an exemplary double-side polishing apparatus, it will be appreciated that many other polishing configurations would benefit from such a stabilizing apparatus, particularly where a large circular plate is used for polishing large or multiple workpieces. Similarly, while the present invention was described in the context of "polishing", it will be appreciated that the present invention may advantageously be employed for grinding, chemical-mechanical polishing, lapping, and other such abrasive operations.

These and other modifications may be made in the design and implementation of various aspects of the invention without departing from the spirit and scope of the invention as set forth in the appended claims.

We claim:

1. An apparatus for polishing at least one workpiece, comprising:

a top assembly, said top assembly comprising a first plate having a bottom surface;

a first polishing surface provided on said bottom surface of said top plate for polishing said at least one workpiece:

a second plate having a top surface, said top surl-ace of said second plate configured to receive said at least one workpiece;

vertical translation means secured to said top assembly;

stabilizing means communicating with said vertical translation means for keeping said first plate substantially aligned with said second plate by restraining the motion of said vertical translation means to a direction substantially perpendicular to said second plate.

2. An apparatus according to claim 1, wherein said vertical translation means comprises:

a first shaft having an upper end and a lower end;

a subcylinder secured to said lower end of said first shaft, said subcylinder pivotally attached to said top assembly.

3. An apparatus according to claim 2, wherein said stabilizing means comprises:

a plurality of vertical rails substantially perpendicular to said second plate;

a substantially rigid lateral support slidably engaging said plurality of vertical rails;

adjustment means for laterally adjusting said subcylinder with respect to said lateral support.

4. An apparatus for polishing at least one workpiece, comprising;

a top assembly said top assembly comprising, a first plate having a bottom surface;

a first polishing surface provided on said bottom surface of said top plate for polishing said at least one workpiece;

a second plate having a top surface, said top surface of said second plate configured to receive said at least one workpiece;

vertical translation means secured to said top assembly;

stabilizing means communicating with said vertical translation means for keeping said first plate substantially aligned with said second plate;

said vertical translation means comprising a first shaft having an upper end and a lower end, and a subcylinder secured to said lower end of said first shaft, wherein said subcylinder is pivotally attached to said top assembly;

said stabilizing means comprising:

a plurality of vertical rails substantially perpendicular to said second plate;

a substantially rigid lateral support engaging said plurality of vertical rails;

adjustment means for laterally adjustment said subcylinder with respect to said lateral support wherein said adjustment means comprises:

an adjustment plate secured to said subcylinder, at least two X-axis adjustment screws anchored to said lateral support and impinging laterally on said alignment plate; and at least two Y-axis adjustment screws anchored to said lateral support and impinging laterally on said alignment plate.

5. An apparatus according to claim 1, wherein said stabilizing means comprises:

a plurality of vertical rails substantially perpendicular to said second plate;

a substantially rigid lateral support engaging said plurality of vertical rails;

an adjustment means for laterally adjusting said vertical translation means with respect to said lateral support.

6. An apparatus for polishing at least one workpiece, said apparatus comprising:

a top assembly, said top assembly comprising a first plate having, a bottom surface;

a first polishing surface provided on said bottom surface of said top plate for polishing said at least one workpiece;

a second plate having a top surface, said top suriface of said second plate configured to receive said at least one workpiece, vertical translation means secured to said top assembly;

a stabilizing, means communicating with said vertical translation means for keeping said first plate substantially aligned with said second plate, said stabilizing means comprising:

a plulality of vertical rails substantially perpendicular to said second plate;

a substantially rigid lateral support engaging said plurality of vertical rails;

adjustment means for laterally adjusting said vertical translation means with respect to said lateral support, wherein said adjustment means comprises:

an alignment plate secured to said vertical translation means; at least two X-axis adjustment screws anchored to said lateral support and impinging laterally on said alignment plate; and at least two Y-axis adjustment screws anchored to said lateral support and impinging laterally on said alignment plate.

* * * * *